US011585085B2

(12) United States Patent
Huber

(10) Patent No.: US 11,585,085 B2
(45) **Date of Patent: *Feb. 21, 2023**

(54) PRECURSORS FOR IMPALING CLIPS AND IMPALING CLIPS FORMED THEREFROM FOR MOUNTING ACOUSTIC PANELS ONTO STRUCTURAL COMPONENTS

(71) Applicant: Kenneth Huber, Seattle, WA (US)

(72) Inventor: Kenneth Huber, Seattle, WA (US)

( * ) Notice: Subject to any disclaimer, the term of this patent is extended or adjusted under 35 U.S.C. 154(b) by 49 days.

This patent is subject to a terminal disclaimer.

(21) Appl. No.: 17/355,699

(22) Filed: Jun. 23, 2021

(65) Prior Publication Data

US 2021/0317655 A1 Oct. 14, 2021

Related U.S. Application Data

(63) Continuation of application No. 16/682,022, filed on Nov. 13, 2019, now Pat. No. 11,060,278.

(60) Provisional application No. 62/802,365, filed on Feb. 7, 2019.

(51) Int. Cl.
*E04B 1/86* (2006.01)
*E04B 1/82* (2006.01)

(52) U.S. Cl.
CPC ..... *E04B 1/86* (2013.01); *E04B 2001/8263* (2013.01)

(58) Field of Classification Search
CPC ... E04B 1/7666; E04B 1/86; E04B 2001/8263
See application file for complete search history.

(56) References Cited

U.S. PATENT DOCUMENTS 800,655 A 10/1905 Kitsee
1,712,493 A * 5/1929 Elmendorf ..... B65D 9/32 217/17
1,782,695 A * 11/1930 Prez ..... A47C 31/026 411/457
1,810,597 A * 6/1931 Corwin ..... E04D 3/3602 52/700
1,915,611 A * 6/1933 Miller ..... E04C 2/18 52/794.1
1,935,536 A * 11/1933 Balduf ..... E04B 2/56 181/290
1,935,574 A * 11/1933 Munroe ..... E04B 1/82 52/351
1,995,173 A * 3/1935 Ehle ..... E04F 13/0835 52/363
2,256,961 A * 9/1941 Pearson ..... B61D 27/0081 52/407.4

(Continued)

*Primary Examiner* — James M Ference
(74) *Attorney, Agent, or Firm* — Caesar Rivise, PC

(57) ABSTRACT

A precursor to form an impaling clip, and an impaling clip formed therefrom. The impaling clip is configured for mounting an acoustic panel on a structural component, e.g., a wall stud, of a building. The impaling clip includes a base member from which a pair of prongs project upward perpendicular to the plane of the base member. The base member includes at least one hole for receipt of a fastener, e.g., a screw, to fixedly secure the base member of the clip to the structural component. Each prong includes a leg portion terminating in pointed head and outwardly projecting under-cut barbs configured to pierce through the back surface of the panel to lock the prong within the panel so that it is resistant to removal.

20 Claims, 5 Drawing Sheets

(56) References Cited

U.S. PATENT DOCUMENTS 2,282,631 A * 5/1942 Winship ..... E04B 2/58 52/361
2,284,301 A * 5/1942 Rieser ..... F25D 23/085 52/716.6
2,325,766 A * 8/1943 Gisondi ..... F16B 15/04 411/921
2,396,030 A * 3/1946 Terry ..... F16L 9/003 411/921
2,580,231 A * 12/1951 Lamm ..... F16L 3/12 52/714
3,011,226 A * 12/1961 Menge ..... F16B 15/0046 411/921
3,016,586 A * 1/1962 Atkins ..... F16B 15/0046 411/921
3,196,499 A * 7/1965 Houvener ..... E04B 1/6108 52/794.1
3,222,831 A * 12/1965 Pritchard ..... E04F 13/0864 52/363
4,128,979 A * 12/1978 Price ..... E04B 2/763 52/489.1
4,235,148 A * 11/1980 Menge ..... F16B 15/0046 52/712
4,292,777 A * 10/1981 Story ..... E04D 13/172 52/742.13
4,389,190 A * 6/1983 Sevink ..... F27D 1/14 432/252
4,394,808 A * 7/1983 Thorsell ..... E04B 2/7409 52/489.2
4,458,387 A * 7/1984 Pearson ..... A47C 31/026 411/442
4,471,592 A * 9/1984 MacKinnon, Jr. .... E04B 1/7675 52/712
4,480,416 A * 11/1984 Judkins ..... E04D 3/3602 52/309.7
4,512,130 A * 4/1985 Pepin ..... E04D 13/1625 52/404.2
4,566,241 A * 1/1986 Schneller ..... E04B 2/7457 52/363
4,653,241 A * 3/1987 Bindi ..... E04B 1/7629 52/746.1
4,704,835 A * 11/1987 Jordan ..... E04B 2/7457 52/489.1
4,736,917 A * 4/1988 Thuresson ..... E04B 1/76 24/304
4,761,928 A * 8/1988 Pichette ..... E04B 2/56 52/855
5,060,434 A * 10/1991 Allison ..... E04B 2/7411 52/745.12
5,060,441 A * 10/1991 Pichette ..... E04B 1/7666 52/855
5,216,859 A * 6/1993 Moreno ..... E04B 2/7411 52/489.2
5,299,403 A * 4/1994 Fentz ..... E04F 13/0835 52/745.12
5,531,052 A * 7/1996 Agar ..... E04B 2/7453 52/715
6,171,043 B1 * 1/2001 Williams ..... F16B 15/0046 52/712
6,367,216 B1 * 4/2002 Mayion ..... E04F 13/042 52/363
9,163,411 B2 * 10/2015 Brady ..... E04F 13/045
10,370,846 B1 * 8/2019 Neuwirt ..... E04B 1/7612
11,060,278 B2 * 7/2021 Huber ..... E04B 1/86
2008/0245010 A1 * 10/2008 Pollack ..... E04B 2/7409 52/404.3
2009/0126302 A1 * 5/2009 Thomas ..... E04B 5/00 52/407.3
2010/0276559 A1 * 11/2010 Sillik ..... E04B 1/7666 248/342
2020/0256052 A1 * 8/2020 Huber ..... E04B 1/7666
2021/0317655 A1 * 10/2021 Huber ..... E04B 1/7666

* cited by examiner

PRECURSORS FOR IMPALING CLIPS AND IMPALING CLIPS FORMED THEREFROM FOR MOUNTING ACOUSTIC PANELS ONTO STRUCTURAL COMPONENTS

CROSS-REFERENCE TO RELATED APPLICATIONS

This utility application is a Continuation of U.S. application Ser. No. 16/682,022 filed on Nov. 13, 2019, entitled Precursors for Impaling Clips and Impaling Clips Formed Therefrom for Mounting Acoustic Panels Onto Structural Components, which claims the benefit under 35 U.S.C. § 119(e) of Provisional Application Ser. No. 62/802,365 filed on Feb. 7, 2019 entitled Impaling Clips For Mounting Acoustic Panels Onto Structural Components, the entire disclosure of which is specifically incorporated by reference herein.

FIELD OF THE INVENTION

This invention relates generally to mounting clips for structural panels of a building and more particularly to precursors for forming impaling clips and impaling clips formed therefrom for mounting acoustic panels on to structural components of a building.

SPECIFICATION

BACKGROUND OF THE INVENTION

The patent literature includes various patents directed to clips for mounting wall panels onto portions, e.g., studs, joist, walls, etc. of a building. Such clips include typically include one or more points, tangs, spikes, prongs or other piecing members which are designed to pierce the rear surface of the wall panel to suspend the panel on the structure to which the clip is secured. Examples of such clips are found in the following U.S. Pat. No. 1,935,536 (Balduf); U.S. Pat. No. 2,282,631 (Winship); U.S. Pat. No. 3,222,831 (Pritchard); U.S. Pat. Nos. 4,128,979 (Price et al.); 4,394,808 (Thorsell); U.S. Pat. No. 4,566,241 (Schneller); U.S. Pat. Nos. 5,060,434 (Allison): and 5,531,052 (Agar).

The mounting of acoustic or sound-absorbing panels in buildings is commonly accomplished by the use of so-called "impaling clips". Such clips typically include plural points, tangs, spikes or prongs that are configured pierce or stick into the rear surface of the acoustic panel to hold the panel in place on the support structure of the building. That support structure may constitute a stud, joist, beam or a wall or ceiling panel itself. In any case, the clip is typically secured to the support structure by means of any suitable type of fastener, e.g., nail, screw, adhesive, etc., depending upon the support structure to which the clip is to be mount to suspend the acoustic panel thereon.

Such impaling clips are commercially available from various sources. For example ATS Acoustics sells "acoustical insulation impaling clips" to install fiberglass or mineral wool boards to a wall. Each clip measures 2⅛"×1½" and has eight spikes to impale the back of a panel to hold it in place. The impaling spikes on the clip are about ¾" deep. A construction adhesive is recommended to ensure a secure panel installation when using such impaling clips.

Acoustic panels which are constructed of fiberglass or other similar materials can be readily effectively mounted on the impaling clips of the prior art. However where the acoustic panels are formed of polyester materials, like those available from www.polysorb.com under the trademark PolySorb, prior art impaling clips have been found wanting insofar as the polyester material renders the panels more likely to become disengaged from the piercing points of the impaling clips than fiberglass acoustic panels. Moreover, the material of such polyester acoustic panels renders them somewhat difficult, if not impossible, to impale. Accordingly, the mounting of polyester panels onto structural components of buildings using prior art impaling clips may necessitate the use of adhesives in addition to the clips or alternative methods without clips to ensure that the acoustic panels remain in place.

Thus, a need exists for impaling clips for polyester acoustic panels which makes use of piercing members which are constructed to easily impale a polyester or PET acoustic panel, while being resistant to displacement once that they have pierced into the acoustic panel, such that the use of additional securement means, e.g., adhesives is unnecessary. The subject invention addresses that need.

BRIEF SUMMARY OF THE INVENTION

One aspect of this invention is a clip for mounting a panel on a support structure. The panel is formed of a material having a rear surface and a front surface. The clip comprises a base, at least one opening and at least one prong. The base includes an undersurface configured to be disposed on an outer surface of the support structure. The at least one opening is configured for receipt of a fastening member to fixedly secure the base on the support structure with the undersurface in engagement with the outer surface of the support structure. The at least one prong projects outward perpendicularly from the base at a bottom of the at least one opening. The at least one prong comprises a leg portion, a sharp head portion having a free end in the form of sharp main point, and at least one subsidiary point. The at least one subsidiary point is in the form of an undercut barb having an edge extending at an acute angle with respect to a side edge of the leg portion. The sharp main point is configured for penetration of the rear surface of the panel, whereupon the sharp head portion, the at least one subsidiary point and at least a portion of the leg portion enters and is fixedly held within the material of the panel between the rear surface and the front surface thereof, with the at least one subsidiary point resisting extraction of the prong from within the material of the panel.

In accordance with one preferred aspect of the clip of this invention, the prong comprises first and second subsidiary points, each of the subsidiary points being in the form of an undercut barb having an edge extending at an acute angle with respect to a side edge of the leg portion.

In accordance with another preferred aspect of the clip of this invention, the leg portion includes a first side edge and a second side edge, and wherein the first subsidiary point is located adjacent the first side edge and the second subsidiary point is located adjacent the second side edge.

In accordance with another preferred aspect of the clip of this invention, the first and second subsidiary points are longitudinally offset from each other along an axis extending a length of the prong.

In accordance with another preferred aspect of the clip of this invention, the leg portion includes a first side edge, and wherein the first and second subsidiary points are located adjacent the first side edge and are longitudinally offset from each other along an axis extending a length of the prong.

In accordance with another preferred aspect of the clip of this invention, the at least one prong comprises two prongs and wherein the at least one opening comprises two openings, with each of the two prongs being located in respective ones of the at least two openings.

In accordance with another preferred aspect of the clip of this invention, the clip is formed a metal.

Another aspect of this invention is a precursor for a clip for mounting a panel on a support structure. The panel is formed of a material having a rear surface and a front surface. The precursor comprises a generally planar sheet, an opening or hole extending through the sheet and a planar prong portion. The generally planar sheet lies in a plane and has at least one window therein. The opening or hole extends through the sheet and is configured for receipt of a fastener therethrough. The planar prong portion is located within the window and within the plane. The planar prong portion comprises a leg portion, a sharp head portion having a free end in the form of sharp main point, and at least one subsidiary point. The at least one subsidiary point is in the form of an undercut barb having an edge extending at an acute angle with respect to a side edge of the leg portion. The planar prong is configured to be bent out of the plane to an orientation perpendicular to the plane.

In accordance with one preferred aspect of the precursor of this invention, the planar prong portion comprises first and second subsidiary points, each of the subsidiary points being in the form of an undercut barb having an edge extending at an acute angle with respect to a side edge of the leg portion.

In accordance with another preferred aspect of the precursor of this invention, the leg portion includes a first side edge and a second side edge, and wherein the first subsidiary point is located adjacent the first side edge and the second subsidiary point is located adjacent the second side edge.

In accordance with another preferred aspect of the precursor of this invention, the first and second subsidiary points are longitudinally offset from each other along an axis extending a length of the prong.

In accordance with another preferred aspect of the precursor of this invention, the leg portion includes a first side edge, and wherein the first and second subsidiary points are located adjacent the first side edge and are longitudinally offset from each other along an axis extending a length of the prong.

In accordance with another preferred aspect of the precursor of this invention, the at least one prong comprises two prongs and wherein the at least one opening comprises two openings, with each of the two prongs being located in respective ones of the at least two openings.

In accordance with another preferred aspect of the precursor of this invention, the clip is formed a metal.

Another aspect of this invention is a combination an acoustic panel having a front surface and a rear surface and an impaling clip configured for mounting the acoustic panel on a support structure. The impaling clip comprises a base, at least one opening, and at least one prong. The base includes an undersurface configured to be disposed on an outer surface of the support structure. The at least one opening is configured for receipt of a fastening member to fixedly secure the base on the support structure with the undersurface in engagement with the outer surface of the support structure. The at least one prong projects outward perpendicularly from the base at a bottom of the at least one opening. The at least one prong comprises a leg portion, a sharp head portion having a free end in the form of sharp main point, and at least one subsidiary point. The at least one subsidiary point is in the form of an undercut barb having an edge extending at an acute angle with respect to a side edge of the leg portion. The sharp main point is configured for penetration of the rear surface of the panel, whereupon the sharp head portion, the at least one subsidiary point and at least a portion of the leg portion enters and is fixedly held within the material of the panel between the rear surface and the front surface thereof, with the at least one subsidiary point resisting extraction of the prong from within the material of the panel.

In accordance with one preferred aspect of the combination of this invention, the prong comprises first and second subsidiary points, each of the subsidiary points being in the form of an undercut barb having an edge extending at an acute angle with respect to a side edge of the leg portion.

In accordance with another preferred aspect of the combination of this invention, the leg portion includes a first side edge and a second side edge, and wherein the first subsidiary point is located adjacent the first side edge and the second subsidiary point is located adjacent the second side edge.

In accordance with another preferred aspect of the combination of this invention, the first and second subsidiary points are longitudinally offset from each other along an axis extending a length of the prong.

In accordance with another preferred aspect of the combination of this invention, the leg portion includes a first side edge, and wherein the first and second subsidiary points are located adjacent the first side edge and are longitudinally offset from each other along an axis extending a length of the prong.

In accordance with another preferred aspect of the combination of this invention, the at least one prong comprises two prongs and wherein the at least one opening comprises two openings, with each of the two prongs being located in respective ones of the at least two openings.

In accordance with another preferred aspect of the combination of this invention, the clip is formed of metal.

In accordance with another preferred aspect of the combination of this invention, the acoustic panel comprises polyester.

DESCRIPTION OF THE DRAWING

The invention will be described in conjunction with the following drawings in which like reference numerals designate like elements and wherein.

DETAILED DESCRIPTION OF THE PREFERRED EMBODIMENTS OF THE INVENTION

Figure 1:
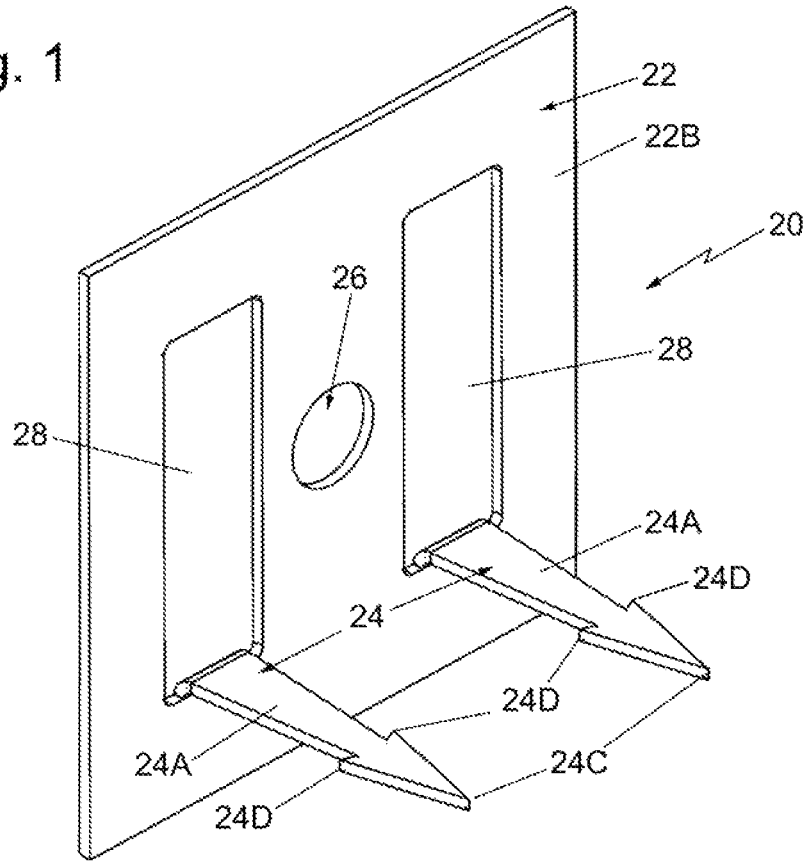
FIG. 1 is an isometric view of one exemplary embodiment of an impaling clip constructed in accordance with this invention.

Referring now to the various figures of the drawing wherein like reference characters refer to like parts, there is shown in FIG. 1 one exemplary impaling clip 20 constructed in accordance with this invention. The clip 20 and the other impaling clips of this invention are particularly suited for fixedly mounting an acoustic panel 10 that is resistant to impaling (e.g., a polyester acoustic panel) on any type of structural component. In the exemplary embodiment shown in FIG. 6 the clip is shown mounted on a conventional wood wall stud 12. However, that is merely exemplary of various types of structural components on which the impaling clips of this invention can be mounted. Thus, impaling clips constructed in accordance with this invention are suitable for mounting on a metal wall stud, a wood or metal ceiling joist, a concrete wall or ceiling, a gypsum board wall or ceiling, etc.

Figure 6:
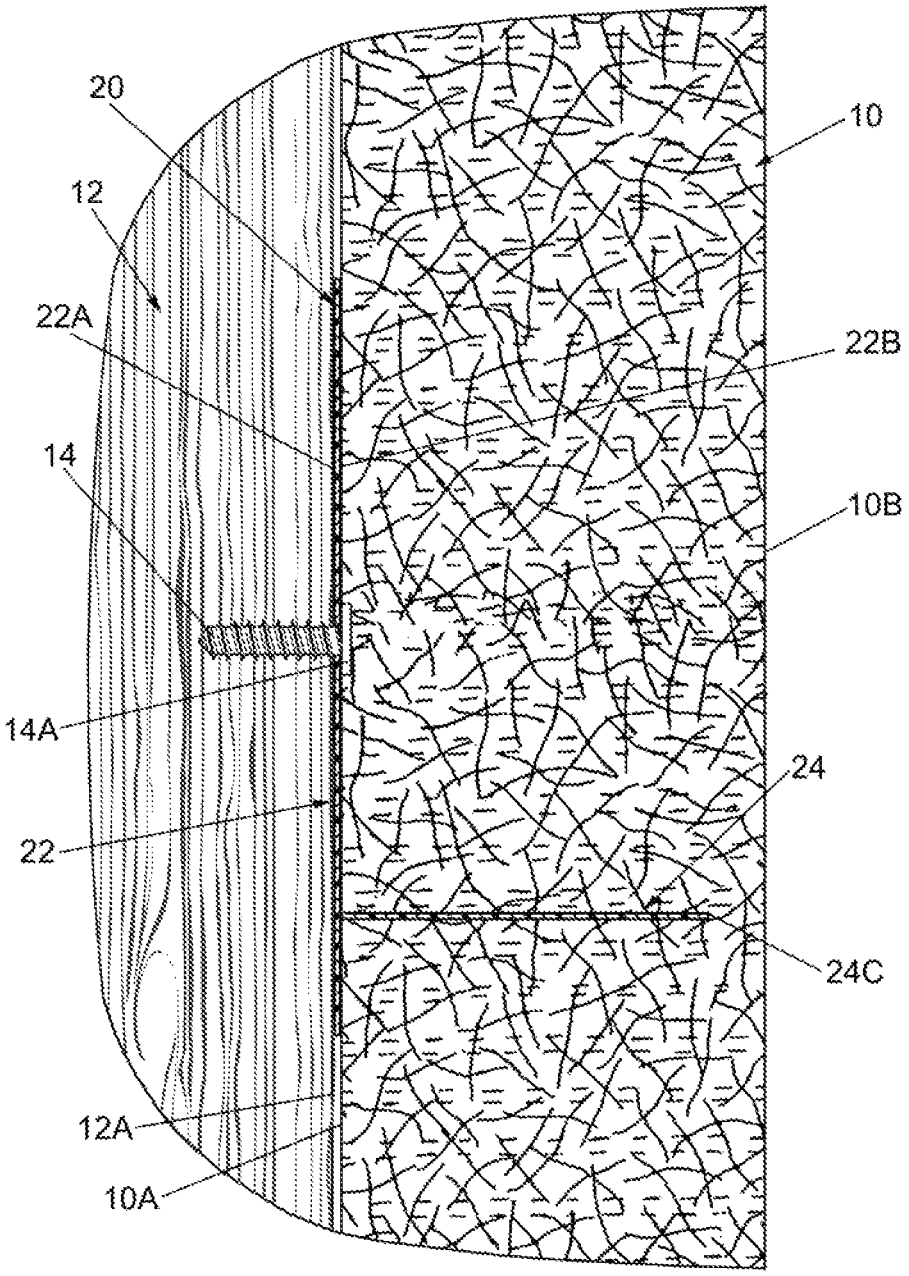
FIG. 6 is an enlarged sectional view taken along line 6-6 of FIG. 2.

Impaling clips constructed in accordance with this invention can be used to mount any type of acoustic panel that is resistant to impaling, e.g., having a density of at least approximately 7 lbs/ft$^2$. In the exemplary embodiment of FIGS. 2 and 6 a portion of the acoustic panel 10 is shown. The panel can be of any size and of any thickness. One particularly efficient sound deadening acoustic panel is that available from PolySorb Architectural Audio Absorption Solutions under the model designation Polysorb. That acoustic panel comprises polyester and is available in the following sizes: 4 foot×9 foot, 4 foot×10 foot, 5 foot×9 foot, 5 foot×10 foot or any custom size. It has a thickness of 1 inch, with a core density: 6.5>7.0 ironed or 5.5>6.0 non-ironed, and a noise reduction coefficient of 0.80>0.85. As best seen in FIG. 6 the panel 10 includes an inner surface 10A and an outer surface 10B. Those acoustic panels are approximately 1.0 inch thick.

The impaling clip 20 basically comprises an integral unit formed of any suitable material, e.g., steel. In the preferred embodiment it is stamped or die-cut from a relatively thin, e.g., 18 gauge, planar sheet of metal, but can be fabricated in other ways. In any case the clip 20 basically comprises a base portion 22, at least one and preferably a pair of piercing members 24, and at least one mounting hole 26. The base portion 22 is generally planar that includes an undersurface 22A and an outer surface 22B. The base portion can be of any shape and size. In the exemplary embodiment shown it is of square shape, whose sides are approximately 1.5 inches. The at least one mounting hole 26 is approximately 0.25 inch in diameter and is located in the center of the base member and is configured to receive any type of fastener therethrough to mount the clip on a structural component, e.g., wall stud 12, of a building.

As mentioned above the impaling clip 20 preferably includes a pair of piercing members 24. Both of the piercing members are preferably of an identical construction and are particularly suited for readily piercing through a hard-to-impale or pierce acoustic panel 10 from the rear surface 10A thereof. Once the panel has been pierced the tip or head of the piercing member will be located within that panel, with no portion of it extending through the outer surface 10B. Moreover, once the piercing member has impaled the acoustic panel and is located therein it will be resistant to displacement due to its shape.

Each of the piercing members 24 is in the form of a sharp elongated prong which projects outward perpendicularly from the plane of the base member 22 at a respective opening or window 28. Each prong 24 is an elongated member having a longitudinal axis, an elongated leg portion 24A extending along the axis and terminating at a wedge shaped head portion 24B. The leg portion 24A is somewhat triangular in shape tapers downward in width from the point at which it projects outward from the base portion 22 at its associated window 28. The wedge shaped head portion 24B has a free end in the form of a main point 24C. The length of each prong 24 from its point 24C to its juncture at the bottom of the window 28 is approximately 0.8125 inch sufficient for securely mounting a 1.0 inch thick acoustic panel on the stud 12. The main point 24C is very sharp, e.g., its included angle is approximately 15 degrees and the edges of the material making up the point are very sharp. Accordingly, the main point 24C can readily pierce into the hard-to-pierce material making up the acoustic panel 10. The wedge shaped head portion 24B also includes at least one subsidiary point 24D located where the head portion 24B merges with the leg portion 24A and is angled away from a side edge of the leg section from which it projects at an acute angle to form an undercut barb, similar to that of a fish-hook. The barb makes extraction of the wedge shaped head portion 24B from the material making up the acoustic panel 10 difficult. In the exemplary embodiment 20 shown the wedge shaped head portion 24B is of shape somewhat like an arrowhead and includes two subsidiary points in the form of undercut barbs 24D which are located opposite each other. Thus, once the head portion of each prong is in place within the acoustic panel 10 it is resistant to removal or displacement by virtue of the gripping action of its barbs onto the material making up the acoustic panel. The exemplary impaling clip 20 has the following dimensions. The length of the head portion 24B measured along its longitudinal axis from the main point 24C to the subsidiary points 24D is approximately 0.313 inch, with the length of the head portion measured along that axis to the undercut portion forming the barb being approximately 0.296 inch, and with maximum width of the head portion being approximately 0.165 inch. The portion of the leg portion 24A which merges with the window 28 is approximately 0.188 inch.

Figure 2:
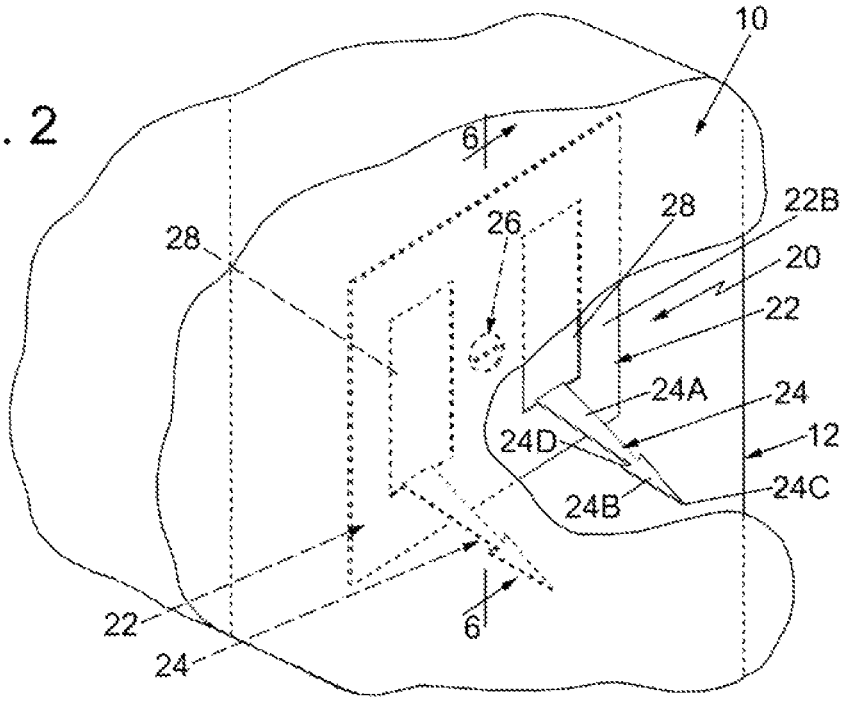
FIG. 2 is an isometric view, partially in section showing the impaling clip of FIG. 1 mounted on a conventional wall stud and supporting a conventional polyester acoustic panel thereon.
Figure 3:
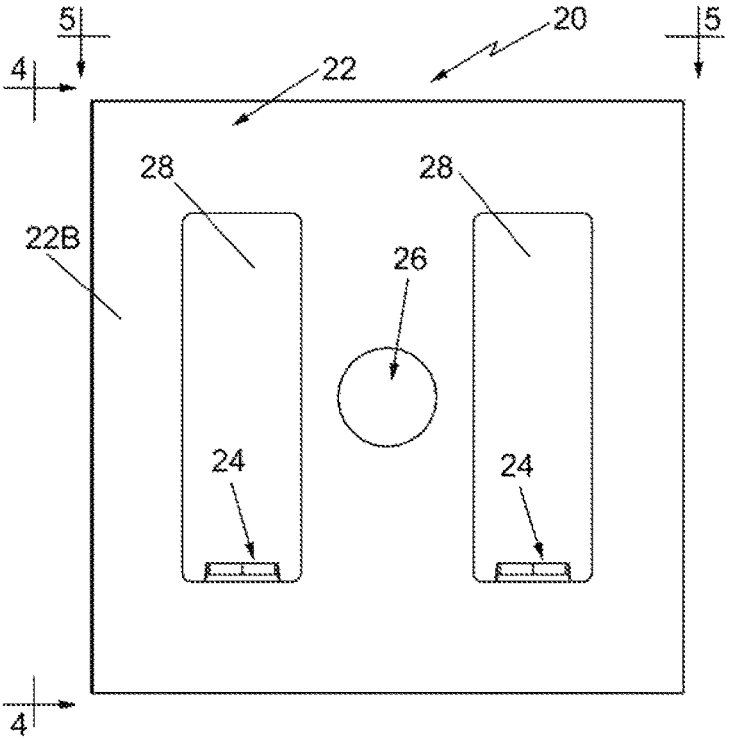
FIG. 3 is a front elevation view of the impaling clip of FIG. 1.
Figure 4:
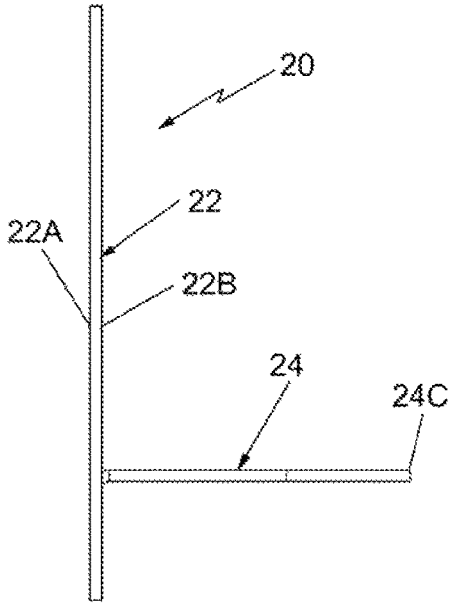
FIG. 4 is a side view taken along line 4-4 of FIG. 3.
Figure 5:
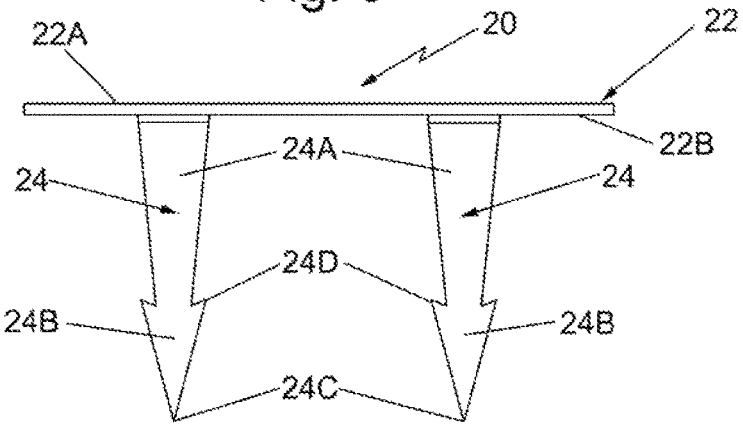
FIG. 5 is a top view taken along line 5-5 of FIG. 3.

Use of the impaling clip 20 will now be described with reference to FIGS. 2 and 6. In particular, if it is desired to mount an acoustic panel 10 on vertically extending wall studs 12 all that is required is to fixedly secure a desired number of impaling clips 20 onto the front face 12A of the studs. If the studs are on sixteen inch centers it is preferred to mount the impaling clips 20 on the front face of the studs so that the impaling clips will be separated from one another by a suitable distance given the thickness, size and weight of the acoustic panel to be mounted on those clips. The mounting of the impaling clips on the studs, or any other structural member onto which the acoustic panel is to be mounted, can be accomplished by any suitable fastener. In the exemplary embodiment shown that fastener is a threaded screw 14. In particular, as shown in FIGS. 2 and 6, the clip is mounted on a wood wall stud 12 by means of the screw 14 whose threaded shank is extended through the mounting hole 26 into the stud and with the screw's head 14A is in engagement with the outer surface 22B of the clip's base 22 contiguous with the mounting hole 26.

Once the impaling clips 20 have been fixedly secured to the front face of the studs 12 the prongs 24 of the clips will face outward from those studs. The acoustic panel 10 to be mounted can then be juxtaposed so that its rear surface 10A faces the pointed or free end 24C of the prongs 24. The acoustic panel can then be pushed into engagement with the tips 24C of the prongs, whereupon the arrowhead-like barbed head 24B of the prongs will pierce through the rear surface 10A of the panel 10 and into the interior of the panel and the rear surface 10A of the panel will engage the front surface 22B of the base member 22 like shown in FIGS. 2 and 6. Once that has occurred the barbs 24D of the prong's head 24B will engage portions of the material making up the panel 10 to prevent the panel from becoming dislodged.

The impaling clip 20 can be made in various ways. One preferred way is by forming it from a precursor in accordance with one aspect of this invention. To that end, the precursor is in the form of a planar panel that can be stamped or die-cut from a relatively thin, e.g., 18 gauge, planar sheet of metal, e.g., steel, which is sized and shaped to form the base portion 22 of the impaling clip 20. If desired, the precursor's planar panel can be fabricated in other ways and made of other materials. In any case, the precursor's planar panel is like that shown in FIG. 1, except that the two prongs 24 are located within the openings or windows 28 in the plane of the panel. Thus, to form the impaling clip 20 from the precursor panel, all that is required is to bend the portions of the panel which will form the prongs 24 out of the plane of the panel so that each such portion is in an orientation perpendicular to the plane of the panel to form the prongs of the impaling clip 20. The precursor's panel also includes a central opening or hole 26 located between the windows 28 to receive the fastener which mounts the impaling clip onto the structural component, e.g., wall stud.

Figure 7:
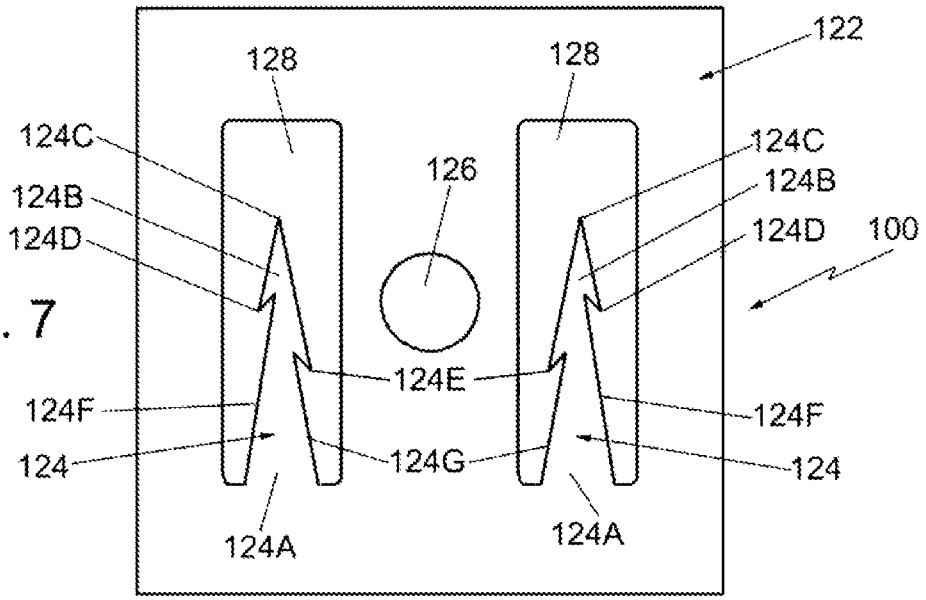
FIG. 7 is a front elevation view of a precursor panel to produce a second exemplary embodiment of a impaling clip constructed in accordance with this invention, that precursor panel includes two portions which when bent out of the plane of the precursor panel form two barbed piercing members of the clip.

Turning now to FIG. 7, there is shown another precursor panel 100 for forming a second exemplary embodiment of an impaling clip 120 (FIG. 8) constructed in accordance with this invention. The precursor panel is stamped or die-cut from a relatively thin, e.g., 18 gauge planar sheet of metal, e.g., steel, but can be fabricated in other ways and made of other materials. The panel 100 includes two windows 128 into which respective portions 124 extend. A central opening or hole 126 is located between the windows 128. The panel portions 124 are configured to be bent out of the plane of the panel 100 so that they project perpendicularly to the plane of the panel to form a pair of piercing members or prongs 124 of the impaling clip 120. The remainder of the panel 100 forms the base portion 122 of the impaling clip 120. The base portion 122, being generally planar, includes an under-surface and an outer surface like that of the embodiment of the impaling clip 20. The base portion 122 can be of any shape and size. In the exemplary embodiment shown it is of square shape, whose sides are approximately 1.5 inches. The hole 126 of the precursor panel forms the mounting hole of the impaling clip 120.

The impaling clip 120 is configured to be mounted on a structural component, e.g. a wall stud 12, of a building in the same manner as that described with respect to the impaling clip 20, e.g., by means of any type of fastener, e.g., a screw 14, extending through the mounting hole 126 and into the structural component, e.g., stud 12, to support the acoustic panel 10 thereon.

Figure 8:
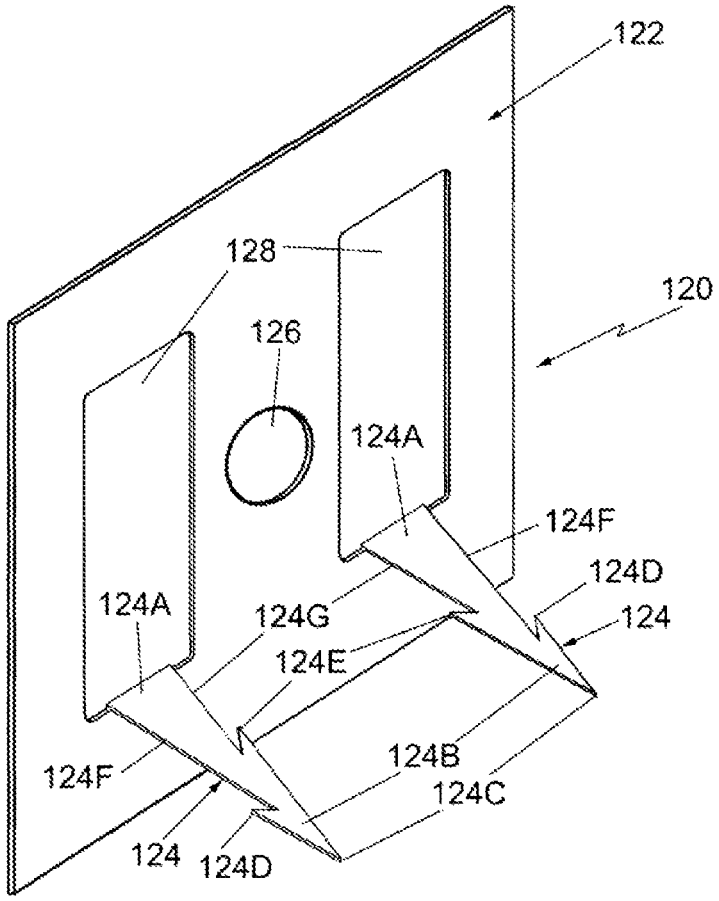
FIG. 8 is front elevation view of the second exemplary impaling clip produced from the precursor panel of FIG. 7.

The impaling clip 120, like the impaling clip 20, preferably includes a pair of piercing members 124, but if desired may include only a single piercing member. As can be seen in FIG. 8, both of the piercing members 124 are preferably of an identical construction, but are mirror images of each other. Each piercing member 124 is particularly suited for readily piercing through a hard-to-impale or pierce acoustic panel 10 (like shown in FIG. 2) from the rear surface 10A thereof. Once the panel has been pierced the tip or head of the piercing member and its barbs (which will be described shortly) will be located within that panel, with no portion of the piercing member extending through the outer surface 10B. Moreover, once the piercing member has impaled the acoustic panel and is located therein it will be resistant to displacement due to its shape, as will now be described. In this regard, each of the piercing members 124 is in the form of a sharp elongated prong which projects outward perpendicularly from the plane of the base member 122 at a respective opening or window 128. Each prong 124 includes an elongated leg portion 124A and a wedge shaped head portion 124B. The leg portion 24A is somewhat triangular in shape tapers downward in width from the point at which it projects outward from the base portion 122 at its associated window 128. The wedge shaped head portion 124B has a free end in the form of a main point 124C. The length of each prong 124 from its point 124C to its juncture at the bottom of the window 128 is slightly shorter, approximately 0.75 inch, than length of the prongs 24, but the maximum width of the leg portion 124A where it merges with the window 128 being approximately the same as the maximum width of the leg portion 24A. The main point 124C is sharp, e.g., its included angle is approximately 25 degrees and the edges of the material making up the main point are very sharp. Accordingly, the main point 124C can readily pierce into the hard-to-pierce material making up the acoustic panel 10.

The wedge shaped head portion 124B also includes two subsidiary points 124D and 124E. The point 124D is located where the head portion 124B merges with the outside edge 124F of the leg portion 124A and is angled away from that outside edge at an acute angle, e.g., approximately 27 degrees, to form an undercut barb 124D. The barb 124D is similar to that of a fish-hook. In a similar manner the point 124E is located where the head portion 124B merges with the inside edge 124G of leg portion 124A and is angled away from that inside edge at an acute angle, e.g., approximately 27 degrees, to form an undercut barb 124E, also similar to that of a fish-hook. The barbs 124D and 124E are longitudinally off-set from each other along the longitudinal axis of the prong 124, e.g., the points 124D and 124E are off-set longitudinally by approximately 0.47 inch, with the point 124D being offset longitudinally along that axis from the main point 124C by approximately 0.33 inch.

As will be appreciated by those skilled in the art, with the prongs 124 constructed like that described above, once they are in place within the acoustic panel 10 the clip 120 is resistant to removal by virtue of the gripping action of the under-cut barbs 124D and 124E, with the off-set feature of those under-cut barbs providing the impaling clip 120 with more holding power than the impaling clip 20.

Figure 9:
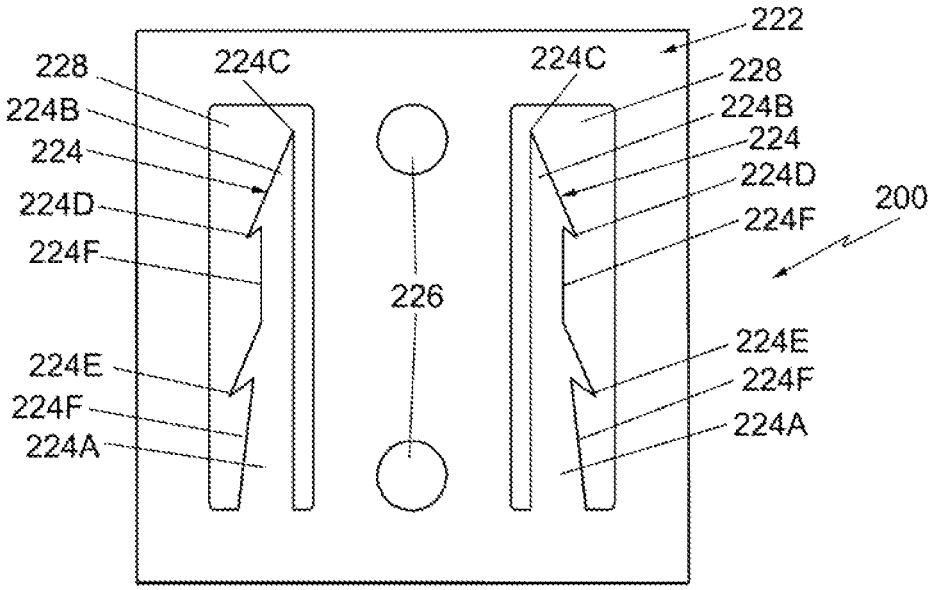
FIG. 9 is a front elevation view of another precursor panel to produce a third exemplary embodiment of a impaling clip constructed in accordance with this invention, that precursor panel includes two portions which when bent out of the plane of the precursor panel form two barbed piercing members of the clip.

FIG. 9 shows a precursor panel 200 for a third exemplary embodiment of an impaling clip 220 (FIG. 10) constructed in accordance with this invention. The impaling clip 220 is designed for use with thicker acoustic panels that are resistant to impaling, e.g., polyester acoustic panels that are 2 inches thick. The precursor panel 200 is stamped or die-cut from a relatively thin, e.g., 18 gauge planar sheet of metal, e.g., steel, but can be fabricated in other ways and made of other materials. The panel 200 includes two windows 228 into which respective portions 224 extend. Two central openings or holes 226 are located between the windows 228 adjacent the upper and lower ends thereof. The panel portions 224 are configured to be bent out of the plane of the panel 200 so that they project perpendicularly to the plane of the panel to form a pair of piercing members or prongs 224 of the impaling clip 220. The remainder of the panel 200 forms the base portion 222 of the impaling clip 220. The base portion 222, being generally planar, includes an under-surface and an outer surface like that of the embodiment of the impaling clip 20. The base portion 222 can be of any shape and size. In the exemplary embodiment shown it is of square shape, whose sides are approximately 2.0 inches. The hole 226 of the precursor panel forms the mounting hole of the impaling clip 220.

The impaling clip 220 is configured to be mounted on a structural component, e.g. a wall stud 12, of a building in the same manner as that described with respect to the impaling clips 20 and 120, e.g., by means of any type of fastener, e.g., a screw 14, extending through the mounting hole 226 and into the structural component 12 to support the acoustic panel 10 thereon.

Figure 10:
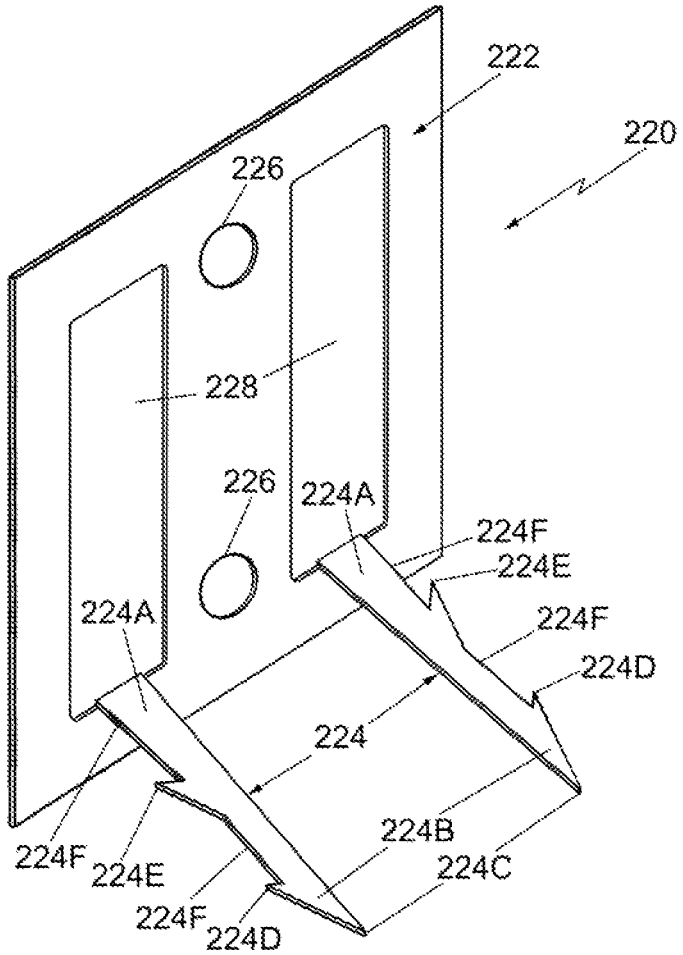
FIG. 10 is front elevation view of the third exemplary impaling clip produced from the precursor panel of FIG. 9.

Moreover, the impaling clip 220, like the impaling clips 20 and 120, preferably includes a pair of piercing members 224, but if desired may include only a single piercing member. As can be seen in FIG. 10, both of the piercing members 224 are preferably of an identical construction, but are mirror images of each other. Each piercing member 224 is particularly suited for readily piercing through a thick hard-to-impale or pierce acoustic panel from the rear surface thereof in a similar manner to the manner the piercing members 24 and 124 of the impaling clips 20 and 120, respectively, are used. Thus, once the thick acoustic panel has been pierced the tip or head of each piercing member 224 and its barbs (which will be described shortly) will be located within that panel, with no portion of it extending through the outer surface. Moreover, once each piercing member has impaled the acoustic panel and is located therein it will be resistant to displacement due to its shape, as will now be described. In this regard, each of the piercing members 224 is in the form of a sharp elongated prong which projects outward perpendicularly from the plane of the base member 222 at a respective opening or window 228. Each prong 224 is an elongated member having a longitudinal axis and includes an elongated leg portion 224A and a wedge shaped head portion 224B. The leg portion 224A is somewhat triangular in shape tapers downward in width from the point at which it projects outward from the base portion 222 at its associated window 228. The wedge shaped head portion 224B has a free end in the form of a main point 224C. The length of the prong 224 from its point 224C to its juncture at the bottom of the window 228 is approximately 1.375 inches. The main point 224C is sharp, e.g., its included angle is approximately 25 degrees and the edges of the material making up the point are very sharp. Accordingly, the main point 224C can readily pierce into the hard-to-pierce material making up the thick acoustic panel. The prong 224 also includes two subsidiary points 224D and 224E. The point 224D is located where the head portion 224B merges with the outside edge 224F of the leg portion 124A and is angled away from that outside edge at an acute angle, e.g., approximately 50 degrees, to form an undercut barb 224D. The barb 224D is similar to that of a fish-hook. The point 224E is a wedge shaped projection projecting outward from the outside edge 224F of the leg portion 224A located between the head portion 224B and the bottom of the window 228. The wedge shaped projection 224E includes a bottom edge which extends at an acute angle, e.g., approximately 50 degrees, to the outside edge 224F to form an undercut barb 224E. The barb 242E is similar to that of a fish-hook. The two undercut barbs 224D and 224E of each prong 224 are longitudinally off-set from each other along the longitudinal axis of the prong by approximately 0.58 inch, with the width of the leg portion 224A measured between the inside and outside edges thereof between the points 224D and 224E being approximately 0.12 inch and with the maximum width of the prong 224 measured where it merges with the window 228 being 0.19 inch. The longitudinally off-set barbs 224D and 224E make extraction of each prong from the thicker material of the acoustic panel very difficult. Thus, once the prongs 224 are in place within the thick acoustic panel the prongs are resistant to removal by virtue of the gripping action of their barbs. This feature provides the impaling clip 220 with sufficient holding power to adequately support a thick, hard-to-pierce, acoustic panel on a structural support, e.g., stud 12.

As should be appreciated by those skilled in the art the above described embodiments of the impaling hook all make use of at least one prong, with that one prong including two undercut barbs, each of which is located at a different position. By so doing each barb of the prong will "grab" the fibers of the acoustic panel at a different position to provide enhanced gripping power. Moreover, those embodiments making use of longitudinally off-set barbs offer the possibility of the off-set barbs grabbing more fibers at different locations in the core of the material making up the acoustic panel. Put another way, with two barbs at one longitudinal position, but laterally off-set, like that of the impaling clip 20, as the prong's pointed head penetrates the acoustic panel, the fibers of the acoustic panel at that point of penetration will be separated by the two laterally off-set barbs since they will be at the same longitudinal position on the longitudinal axis of the prong, whereas the longitudinally off-set barbs of the impaling clips 120 and 220 will grab the fibers of the acoustic panel at different levels within the panel to provide a better grab of those fibers and hence better securement of the panel to the impaling clip.

Notwithstanding the forgoing, it must be pointed out at this juncture that while the exemplary embodiments of the invention as described above make use of a pair of barbed prongs, each of which includes two barbs that is merely exemplary. Thus, any impaling clip constructed in accordance with this invention can include any number of barbed prongs, with the number of barbs thereon being selected for the type panel to be supported by the impaling clip and the thickness of that panel. Moreover, the shape, cross-section and size of the prongs can be different than that shown and described above, so long as each prong is barbed to be resistant to removal from within the interior of the panel once it pierces into the interior of the panel. The length of the prongs will depend upon the thickness of the acoustic panel to be mounted. Thus, for mounting an acoustic panel which is approximately 1 inch in thickness, the prongs should be less than 1 inch so that the pointed free end does not extend out through the outer surface 10B of the panel 10. It has been found that prongs of approximately at least 0.7 inch in length are suitable for mounting 1 inch thick polyester acoustic panels and prongs of approximately at least 1.375 inch in length are suitable for mounting 2 inch thick polyester acoustic panels. The maximum width of the either the head portion or any of its subsidiary points will also depend upon the thickness and weight and composition of the panel to be mounted thereby. Thus, for example, the 0.7 inch length prong 24 described above would make use of a head portion having a width of approximately 0.15 inch. However, those values can be changed, if desired.

Without further elaboration the foregoing will so fully illustrate my invention that others may, by applying current or future knowledge, adopt the same for use under various conditions of service.

I claim:

1. A clip for mounting a panel on a support structure, the panel being formed of a material having a rear surface and a front surface, said clip comprising:

a base including an undersurface configured to be disposed on an outer surface of the support structure, said base comprising at least one window, said at least one window being of a rectangular geometric shape having four edges and a cross-sectional area bounded by said four edges, one of said four edges being a bottom edge;

at least one opening for receipt of a fastening member to fixedly secure said base on the support structure with said undersurface in engagement with the outer surface of the support structure;

at least one prong projecting outward perpendicularly from said base at said bottom edge of said at least one window, said at least one prong having a cross-sectional area less than said cross-sectional area of said at least one window, said at least one prong comprising a leg portion, a sharp head portion having a free end comprising a sharp main point, and at least one subsidiary point, said at least one subsidiary point comprising an undercut barb having an edge extending at an acute angle with respect to a side edge of said leg portion, said sharp main point being configured for penetration of the rear surface of the panel, whereupon said sharp head portion, said at least one subsidiary point and at least a portion of said leg portion enters and is fixedly held within the material of the panel between the rear surface and the front surface thereof, with said at least one subsidiary point resisting extraction of said prong from within the material of the panel.

2. The clip of claim 1, wherein said prong comprises first and second subsidiary points, each of said subsidiary points comprising an undercut barb having an edge extending at an acute angle with respect to a side edge of said leg portion.

3. The clip of claim 2, wherein said leg portion includes a first side edge and a second side edge, and wherein said first subsidiary point is located adjacent said first side edge and said second subsidiary point is located adjacent said second side edge.

4. The clip of claim 3, wherein said first and second subsidiary points are longitudinally offset from each other along an axis extending a length of said prong.

5. The clip of claim 2, wherein said leg portion includes a first side edge, and wherein said first and second subsidiary points are located adjacent said first side edge and are longitudinally offset from each other along an axis extending a length of said prong.

6. The clip of claim 1, wherein said at least one prong comprises two prongs and wherein said at least one opening comprises two openings, with each of said two prongs being located in respective ones of said at least two openings.

7. A precursor for a clip for mounting a panel on a support structure, the panel being formed of a material having a rear surface and a front surface, said precursor comprising:

a generally planar sheet lying in a plane and having at least one window therein, said at said at least one window being of a rectangular geometric shape having four edges and a cross-sectional area bounded by said four edges, one of said four edges being a bottom edge;

an opening or hole extending through said sheet and configured for receipt of a fastener therethrough; and a planar prong portion extending from said bottom edge within said at least one window, said planar prong portion lying in said plane and having a cross-sectional area less than said cross-sectional area of said at least one window, said at least one planar prong portion comprising a leg portion, a sharp head portion having a free end comprising a sharp main point, and at least one subsidiary point, said at least one subsidiary point comprising an undercut barb having an edge extending at an acute angle with respect to a side edge of said leg portion, said planar prong being configured to be bent out of said plane to an orientation perpendicular to said plane.

8. The precursor for a clip of claim 7, wherein said planar prong portion comprises first and second subsidiary points, each of said subsidiary points comprising an undercut barb having an edge extending at an acute angle with respect to a side edge of said leg portion.

9. The precursor for a clip of claim 8, wherein said leg portion includes a first side edge and a second side edge, and wherein said first subsidiary point is located adjacent said first side edge and said second subsidiary point is located adjacent said second side edge.

10. The precursor for a clip of claim 8, wherein said first and second subsidiary points are longitudinally offset from each other along an axis extending a length of said prong.

11. The precursor for a clip of claim 8, wherein said leg portion includes a first side edge, and wherein said first and second subsidiary points are located adjacent said first side edge and are longitudinally offset from each other along an axis extending a length of said prong.

12. The precursor for a clip of claim 7, wherein said at least one prong comprises two prongs and wherein said at least one opening comprises two openings, with each of said two prongs being located in respective ones of said at least two openings.

13. In combination an acoustic panel having a front surface and a rear surface and an impaling clip configured for mounting the acoustic panel on a support structure, said impaling clip comprising:

a base including an undersurface configured to be disposed on an outer surface of the support structure, said base comprising at least one window, said at least one window being of a rectangular geometric shape having four edges and a cross-sectional area bounded by said four edges, one of said four edges being a bottom edge;

at least one opening for receipt of a fastening member to fixedly secure said base on the support structure with said undersurface in engagement with the outer surface of the support structure;

at least one prong projecting outward perpendicularly from said base at said bottom edge of said at least one window, said at least one prong having a cross-sectional area less than said cross-sectional area of said at least one window, said at least one prong comprising a leg portion, a sharp head portion having a free end comprising a sharp main point, and at least one subsidiary point, said at least one subsidiary point comprising an undercut barb having an edge extending at an acute angle with respect to a side edge of said leg portion, said sharp main point being configured for penetration of the rear surface of the acoustic panel, whereupon said sharp head portion, said at least one subsidiary point and at least a portion of said leg portion enters and is fixedly held within the material of the acoustic panel between the rear surface and the front surface thereof, with said at least one subsidiary point resisting extraction of said prong from within the material of the acoustic panel.

14. The combination of claim 13, wherein said prong comprises first and second subsidiary points, each of said subsidiary points comprising an undercut barb having an edge extending at an acute angle with respect to a side edge of said leg portion.

15. The combination of claim 14, wherein said leg portion includes a first side edge and a second side edge, and wherein said first subsidiary point is located adjacent said first side edge and said second subsidiary point is located adjacent said second side edge.

16. The combination of claim 15, wherein said first and second subsidiary points are longitudinally offset from each other along an axis extending a length of said prong.

17. The combination of claim 14, wherein said leg portion includes a first side edge, and wherein said first and second subsidiary points are located adjacent said first side edge and are longitudinally offset from each other along an axis extending a length of said prong.

18. The combination of claim 13, wherein said at least one prong comprises two prongs and wherein said at least one opening comprises two openings, with each of said two prongs being located in respective ones of said at least two openings.

19. The combination of claim 13, wherein said clip is formed a metal.

20. The combination of claim 13, wherein said acoustic panel comprises polyester.

* * * * *